US012497841B2

(12) United States Patent
Matthews et al.

(10) Patent No.: US 12,497,841 B2
(45) Date of Patent: Dec. 16, 2025

(54) EARTH BORING REAMER

(71) Applicant: Orvil Technologies, LLC, Amber, OK (US)

(72) Inventors: Ryan Matthews, Powderly, TX (US); Matt Waitman, Tuttle, OK (US); Rafe Neasbitt, Tuttle, OK (US)

(73) Assignee: Orvil Technologies, LLC, Amber, OK (US)

( * ) Notice: Subject to any disclaimer, the term of this patent is extended or adjusted under 35 U.S.C. 154(b) by 0 days.

(21) Appl. No.: 19/196,354

(22) Filed: May 1, 2025

(65) Prior Publication Data

US 2025/0341133 A1 Nov. 6, 2025

Related U.S. Application Data

(60) Provisional application No. 63/642,122, filed on May 3, 2024.

(51) Int. Cl.
*E21B 10/26* (2006.01)

(52) U.S. Cl.
CPC ..... *E21B 10/26* (2013.01)

(58) Field of Classification Search
CPC ..... E21B 10/26; E21B 10/62; E21B 10/60; E21B 7/28; E21B 7/04
See application file for complete search history.

(56) References Cited

U.S. PATENT DOCUMENTS

| | | | | |
|---|---|---|---|---|
| 5,308,150 | A | 5/1994 | Whitehouse | |
| 6,250,403 | B1 | 6/2001 | Beckwith | |
| 6,926,100 | B1 | 8/2005 | Anthony et al. | |
| 7,108,082 | B1 | 9/2006 | Anthony et al. | |
| 8,201,647 | B2 | 6/2012 | Zulak | |
| 8,312,941 | B2 | 11/2012 | Mirchandani et al. | |
| 11,384,601 | B2 | 7/2022 | Graham et al. | |
| 11,578,537 | B2 | 2/2023 | Smith | |
| 2009/0145666 | A1 | 6/2009 | Radford et al. | |
| 2011/0155472 | A1 | 6/2011 | Lyons et al. | |
| 2013/0248254 | A1 | 9/2013 | Ainge | |
| 2013/0264122 | A1 | 10/2013 | Radford et al. | |
| 2014/0305708 | A1 | 10/2014 | Gunsaulis | |
| 2016/0356091 | A1* | 12/2016 | Slaughter, Jr. | E21B 7/046 |
| 2016/0376847 | A1 | 12/2016 | Matthews | |
| 2021/0025242 | A1* | 1/2021 | Graham | E21B 7/046 |
| 2021/0372202 | A1 | 12/2021 | Wagner et al. | |
| 2023/0243217 | A1* | 8/2023 | Smith | E21B 10/567 175/406 |

OTHER PUBLICATIONS

International Search Report and Written Opinion dated Jun. 26, 2025; PCT/US2025/027320; 11 pgs.

* cited by examiner

*Primary Examiner* — Caroline N Butcher
(74) *Attorney, Agent, or Firm* — Dunlap Codding, P.C.

(57) ABSTRACT

A reamer comprising a shaft, a body, blades and a plurality of cutting elements is described. The shaft has an outer peripheral surface, and a first longitudinal axis. The body is connected to and extends from the outer peripheral surface of the shaft. The blades extend outwardly from the body. The blades each have an outer peripheral surface having a curved profile extending from a leading end of the blade toward a trailing end of the blade. The cutting elements extend outwardly from the outer peripheral surface of each of the blades. At least some of the cutting elements have a non-cylindrical shape configured for cutting through dirt.

17 Claims, 11 Drawing Sheets

EARTH BORING REAMER

CROSS-REFERENCE TO RELATED APPLICATIONS

The present application claims priority to the provisional patent application identified by U.S. Ser. No. 63/642,122, filed on May 3, 2024.

BACKGROUND

A process known as horizontal directional drilling is utilized to install various underground utilities in a manner that does not disrupt the surface. A drill machine is used to drill a pilot bore that extends beneath the ground surface from an entry hole at the ground surface (i.e., a starting point) to an exit hole at the ground surface (i.e., an ending point). The pilot bore is drilled by rotating and pushing a ground-engaging tool (e.g., a drill bit) attached to the end of a drill rod. The length of the pilot bore is extended by stringing multiple rods together to form a drill string. The direction of drilling can be controlled (i.e., the drill string can be "steered") by various techniques to control the depth of the pilot bore and the location of the exit hole. The location of the drill string after the pilot bore is completed represents the desired area of the utility to be installed.

The drill bit is removed after the pilot bore is drilled, and a second earth-boring tool is installed onto the end of the drill string. This tool is generally known as a reamer. Its function is to ream or widen the drilled pilot bore to a sufficient diameter to allow utility installation. To provide a reaming function, the reamer is typically pulled back through the pilot bore by the drill string as the drill string is withdrawn from the pilot bore. Often, the utility being installed is attached with a swivel at the end of the reamer so that the utility is pulled into the reamed bore immediately behind the reamer. In this way, withdrawing the drill string will simultaneously result in the installation of the utility. The type of utilities installed typically includes telecommunications, power, water, natural gas pipelines, liquid gas pipelines, potable water pipes, and sewers.

A need exists for an improved reamer that is cost-effective to manufacture and bores efficiently through dirt within the earth. It is to such a reamer that the inventive concepts disclosed herein are directed.

DETAILED DESCRIPTION OF EXEMPLARY EMBODIMENTS

Figure 1:
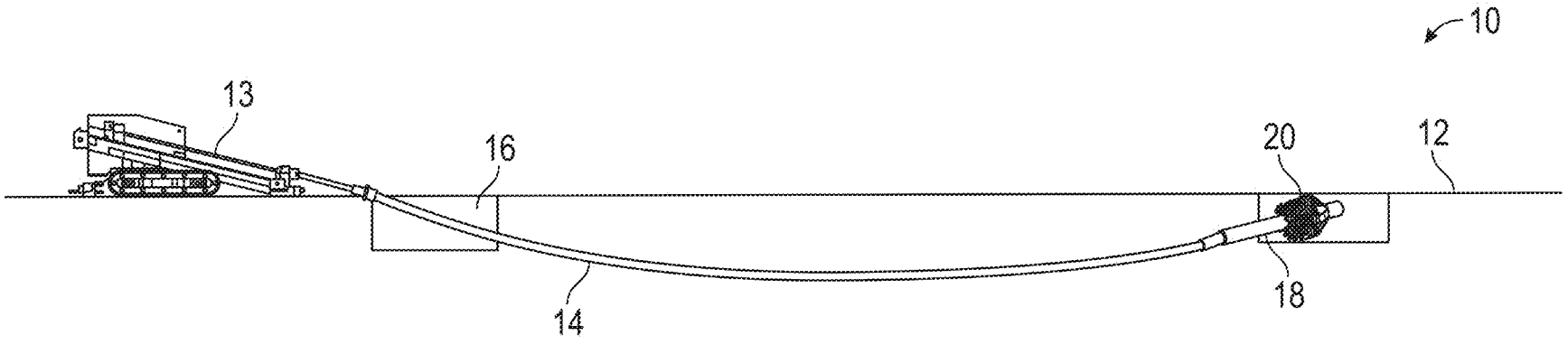
FIG. 1 is a diagrammatic view of a back-reaming operation using a reamer constructed in accordance with the inventive concepts disclosed herein to bore through dirt within the earth.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein are for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, the use of the "a" or "an" is employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and in particular FIG. 1, an example of a horizontal directional drilling system 10 illustrated. In back-reaming operations, the horizontal directional drilling system 10 is used to drill a pilot bore into a subsurface 12. The horizontal drilling machine 13 is used to drive the drill string 14 into the subsurface 12. The distal end of drill string 14 is typically equipped with a cutting tool (e.g., a bit) for cutting the pilot bore. To lengthen the pilot bore, pipes or rods are sequentially added to the drill string 14 until the drill string 14 extends from an entry point 16 adjacent to the horizontal directional drilling system 10 to an exit point 18 in which the cutting tool exits the subsurface 12. Thus, the drill string 14 is formed by a plurality of drill rods connected together. By rotating the drill string 14 while concurrently applying thrust to drill string 14, the cutting tool at the end of the drill string 14 cuts the pilot bore.

After the drill string 14 has been pushed from entry point 16 to exit point 18, the cutting tool is removed from the far end of drill string 14 and replaced with a reamer 20 (also referred to as a back reamer or hole opener). Often, a utility (not shown) being installed is attached with a swivel (also not shown) at the end of the reamer 20 so that the utility is pulled into the reamed bore immediately behind the reamer 20. In this way, withdrawing the drill string 14 will simultaneously result in the installation of the utility. The type of utilities installed typically includes telecommunications, power, water, natural gas pipelines, liquid gas pipelines, potable water pipes, and sewers.

Once the reamer 20 and the utility have been attached to the drill string 14, the horizontal drilling machine 13 is used to withdraw the drill string 14. As the drill string 14 is withdrawn, the drill string 14 is rotated causing the reamer 20 to also rotate cut into the subsurface 12, e.g., dirt, to enlarge the pilot bore. As the drill string 14 is withdrawn, the utility is concurrently pulled into the opened bore.

While back-reaming operations are taking place, drilling fluid, such as drilling mud or lubricant, may be pumped down the drill string 14 into the reamer 20 and distributed within the borehole to promote cutting by the reamer 20 during the back-reaming process. While the operations discussed herein are referred to as "reaming), "hole opening" or "back-reaming" operations, they should be understood to include "swabbing" operations—that is, using reamer 20 to clean the pilot bore of debris without significantly expanding the radius of the borehole.

Referring now to FIGS. 2-13, the reamer 20 constructed in accordance with the inventive concepts disclosed herein will be described in detail. Broadly, the reamer 20 includes a shaft 22, a body 24 formed of a plurality of plates **26*a*-26*h* (FIGS. 5 and 6), a plurality of blades 28, and a plurality of cutting elements 30**.

Figure 3:
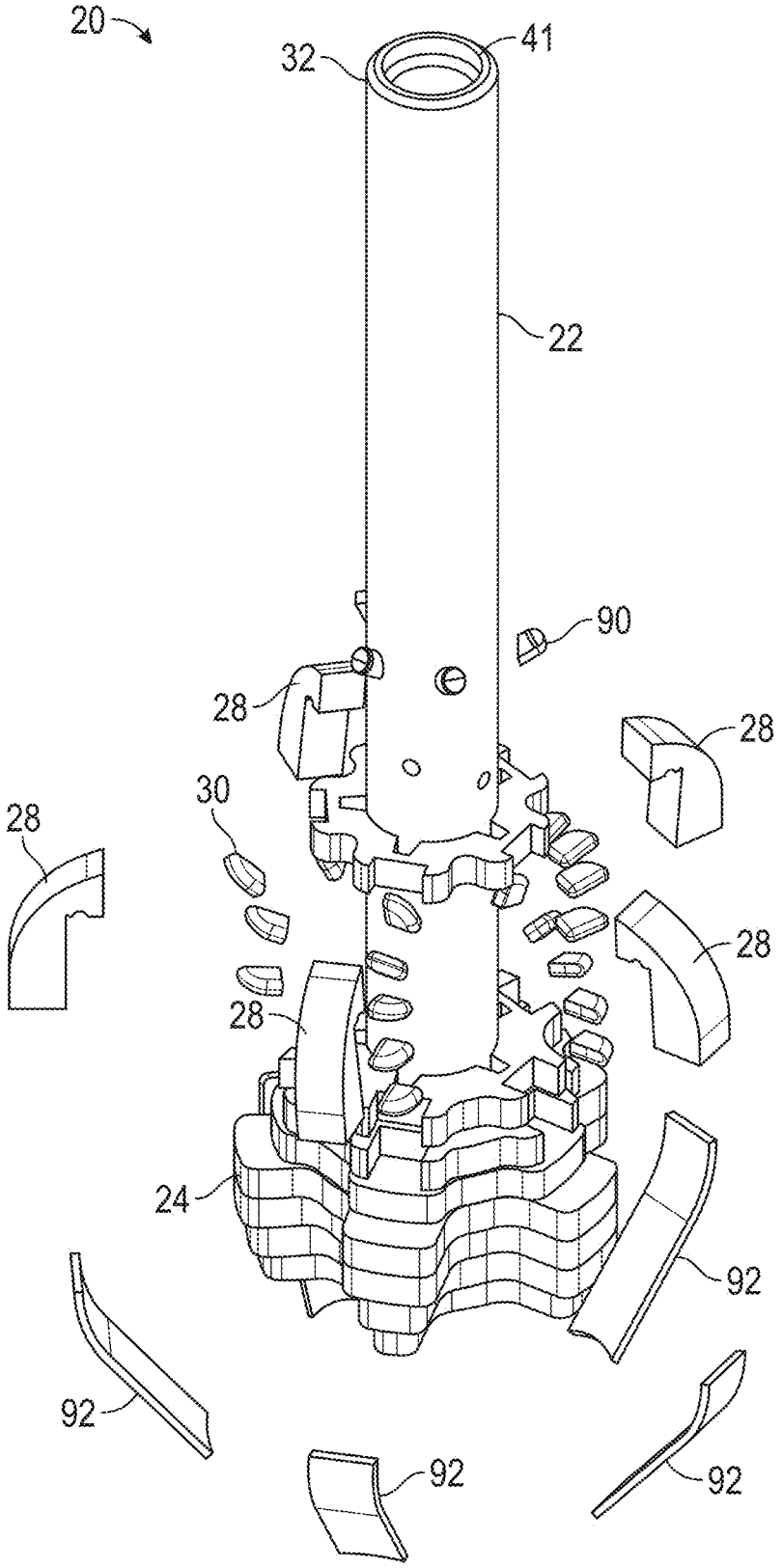
FIG. 3 is an exploded, perspective view of the reamer.
Figure 10:
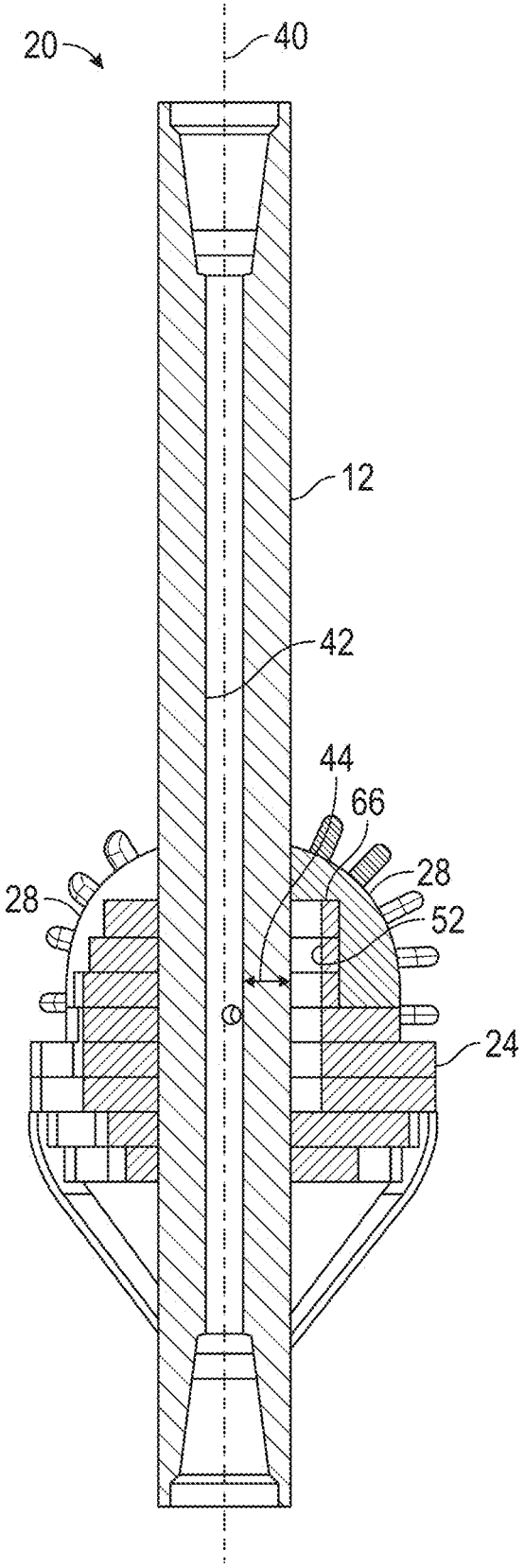
FIG. 10 is a sectional view of the reamer taken along line 10-10 of FIG. 2.

The shaft 22 may be a tubular member with a leading end 32, a trailing end 34 (FIG. 4), a sidewall 36, an outer peripheral surface 38, and a longitudinal axis 40 (FIG. 10). The leading end 32 of the shaft 22 is connectable to the drill string 14 (FIG. 1) and when connected to the drill string may be translated (forward and backward) and rotated through operation of the drill string 14. The leading end 32 has a connection point 41 (FIG. 3). The connection point 41 facilitates torque transmitting connection between the reamer 20 and the drill string 14 (FIG. 1). The connection point 41 may be a threaded surface, pins, splines, geometrical features, or other known torque transmitting features. The trailing end 34 also has a connection point 43 that can be used to connect to the utility via a swivel, by way of example. The connection point 43 may be a threaded surface, pins, splines, or other geometrical features.

Figure 4:
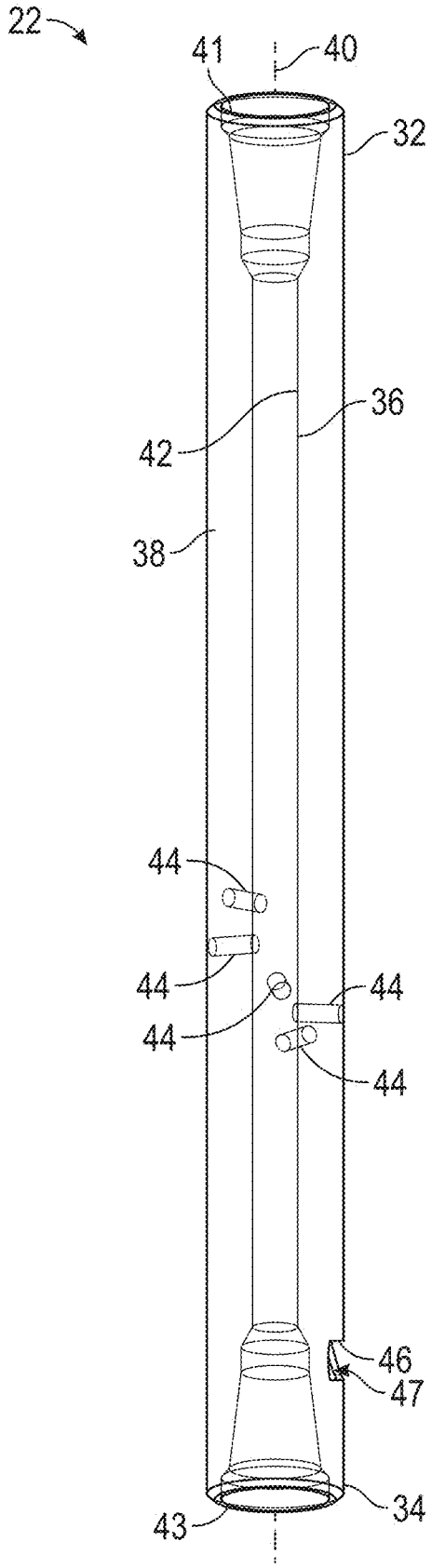
FIG. 4 is a transparent, perspective view of a shaft of the reamer.

In the embodiment shown, the shaft 22 defines a central fluid flow passage 42 and has a plurality of fluid flow ports 44 radially disposed through the sidewall 36 of the shaft 22. As shown in FIG. 4, the shaft 12 has five fluid flow ports 44 equally spaced about the shaft at 72-degree intervals. To maintain the structural integrity of the shaft 22, the fluid flow ports 44 may be spaced longitudinally relative to one another. The shaft 22 may be provided with an ID notch 46 between the body 24 and the trailing end 34. The ID notch 46 provides a surface 47 inset inside an outer peripheral surface of the shaft 22 to protect identifying information on the surface 47 from being abraded.

Figure 2:
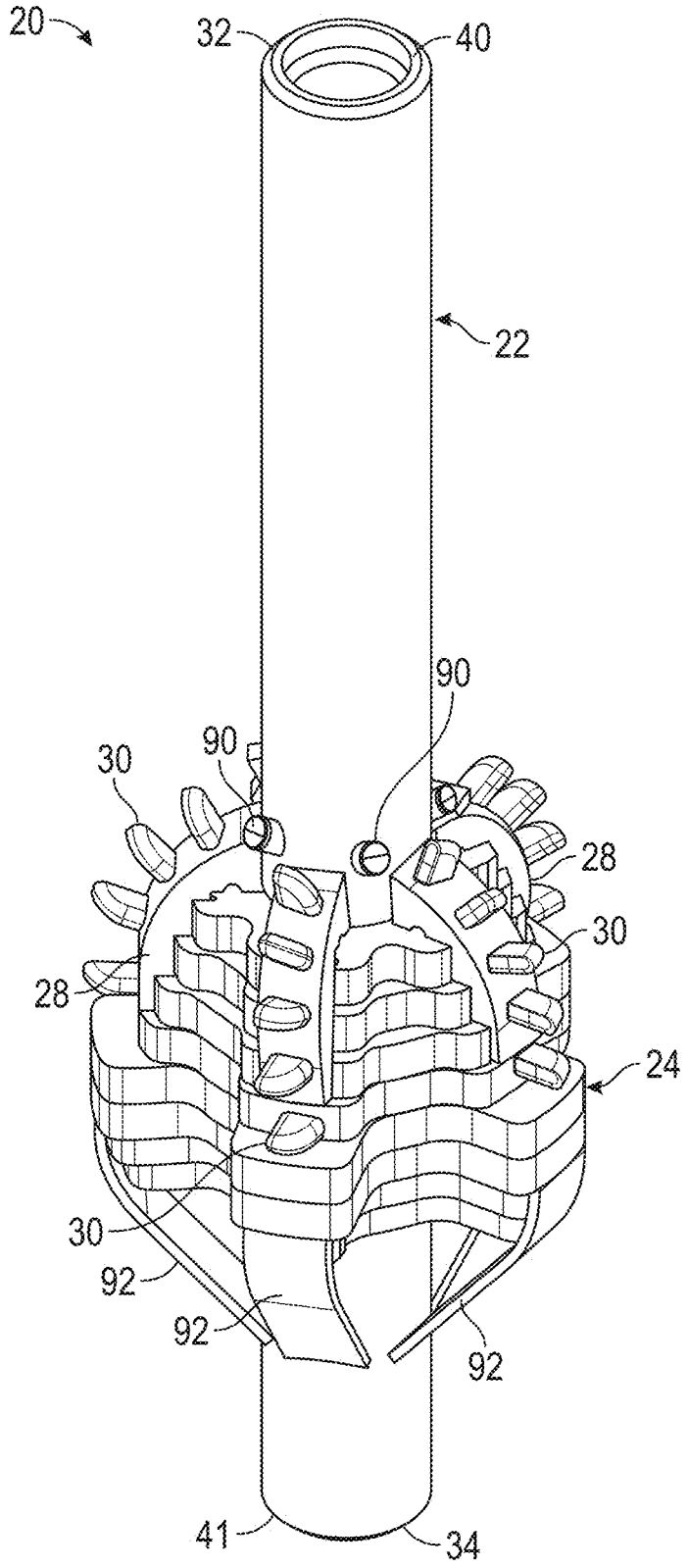
FIG. 2 is a perspective view of the reamer of FIG. 1.
Figure 5:
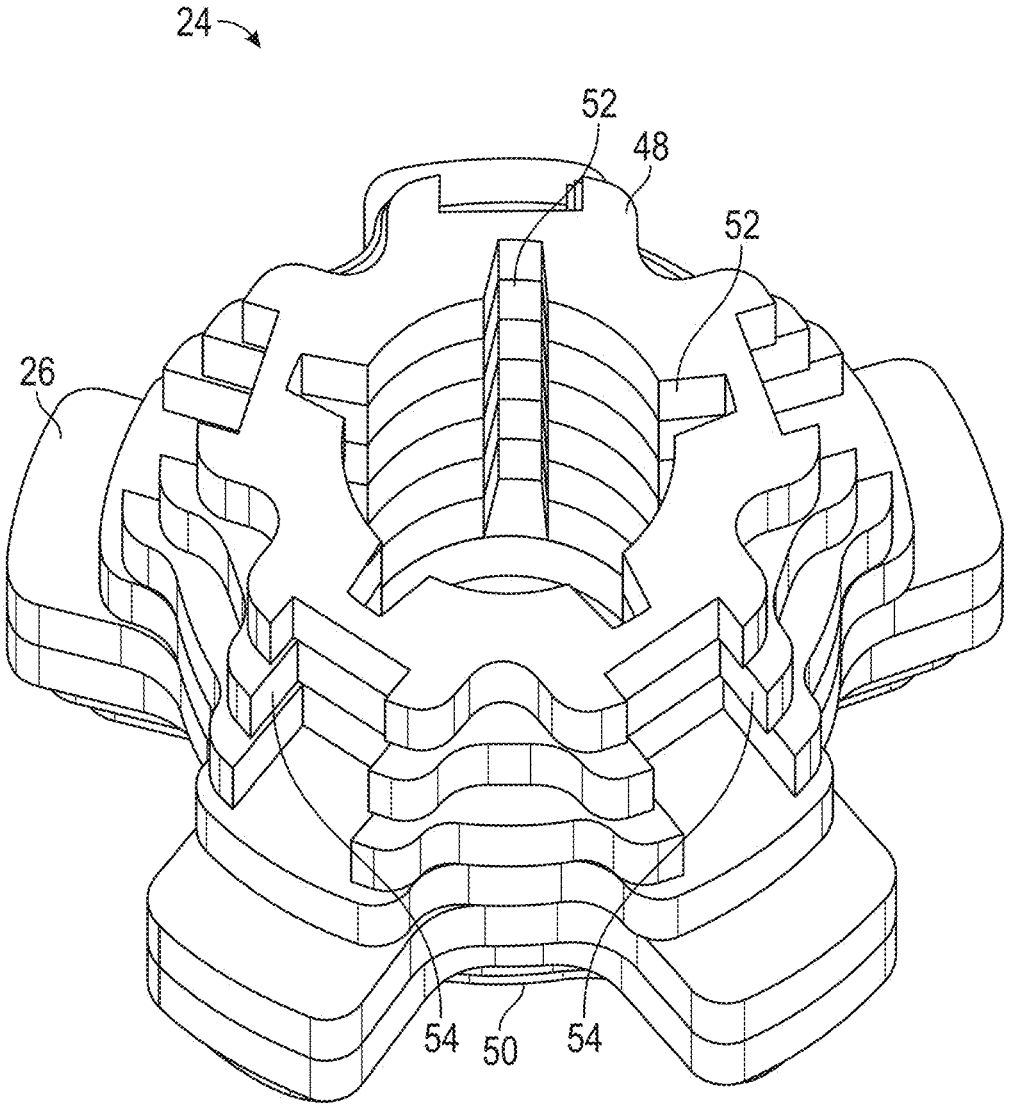
FIG. 5 is a perspective view of a body formed of a plurality of plates in accordance with the present disclosure.

Referring to FIGS. 2, 3, 5, 6, and 10, the body 24 is connected to and extends from the outer peripheral surface 38 of the shaft 22. The body 24 is characterized as having a leading end 48, a trailing end 50, a plurality of internal fluid flow slots 52 in fluid communication with the fluid flow ports 44 of the shaft 22, and a plurality of external slots 54 extending from the leading end 48 of the body 24 toward the trailing end 50 of the body 24 and spaced circumferentially about the body 24. In some embodiments, the external slots 54 terminate prior to the trailing end 50 of the body 24. The body 24 may be formed from the plurality of plates 26 stacked on one another although in some embodiments the body 24 may be a solid member not made from stacked plates. In these embodiments, the body 24 may be constructed as a solid member using casting or milling techniques. The body 24 is connected to the shaft 22 by welding or other rigid connected technique. When the body 24 is constructed of the plates 26, each of the plates 26 may be welded or otherwise connected to the shaft 22 and to each other. Upon welding the plates 26 together as shown in FIGS. 2 and 5, the body 24 is formed of multiple layers.

Figure 6:
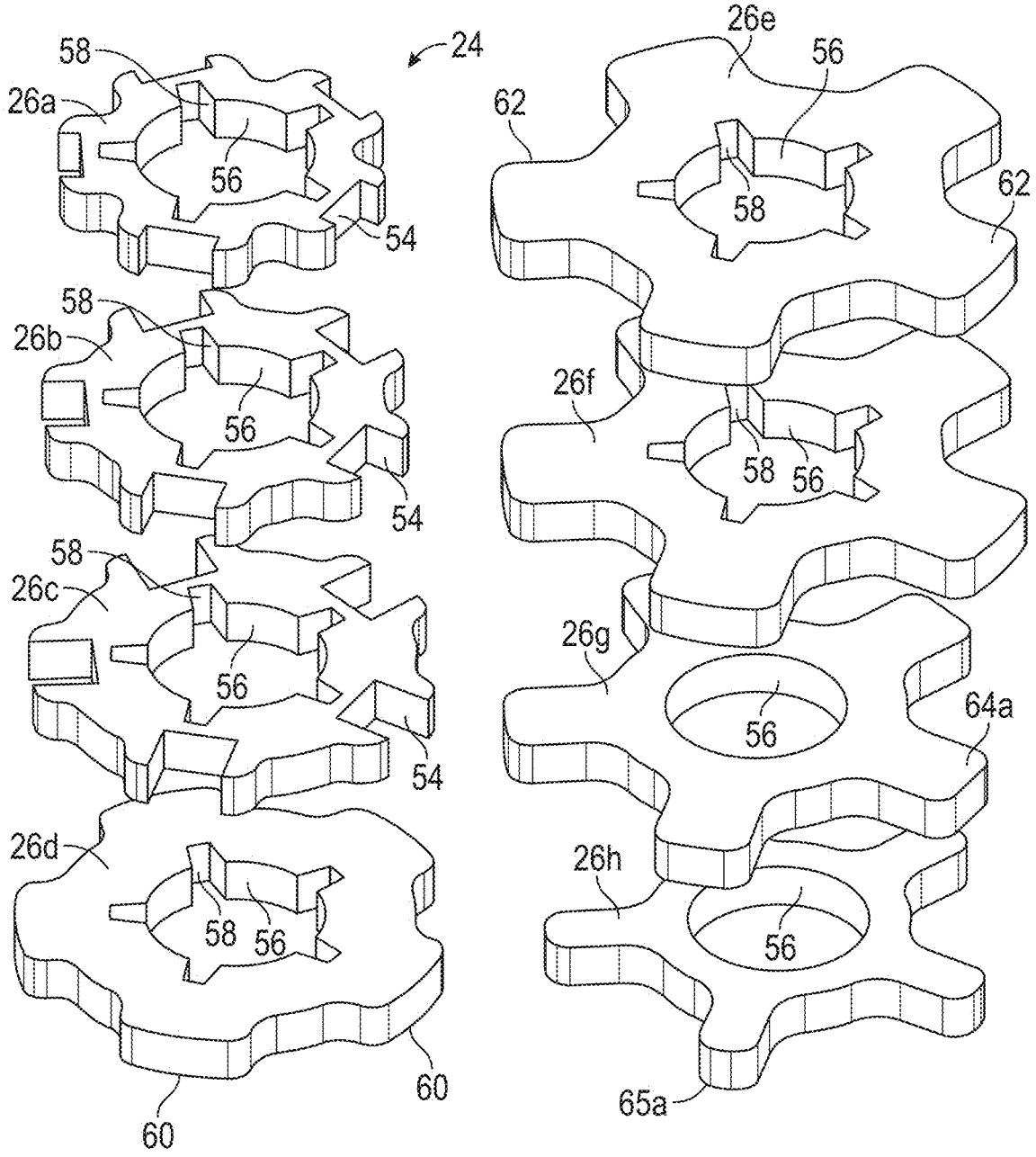
FIG. 6 is an exploded, perspective view of the body.
Figure 7:
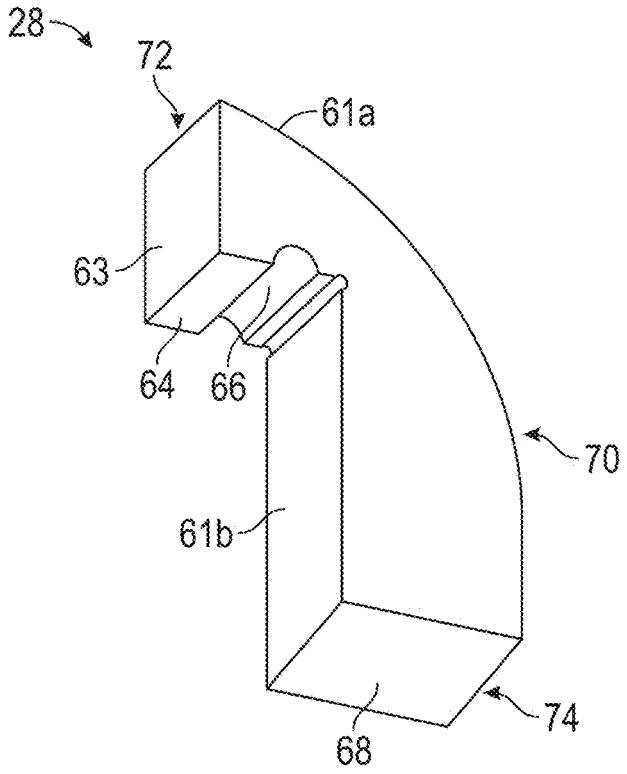
FIG. 7 is a perspective view of a blade configured to be positioned within a slot formed within the body.

The body 24 can be formed in varied shapes to support the blades 28 and the cutting elements 30 in a selected arrangement and to varied sizes. To this end, the plates 26 can be formed in varied shapes and sizes to form the body 24 with the desired shape and size. Also, the number of plates 26 used to form the body 24 may be varied. In one embodiment, the body 24 may be formed of eight plates **26*a*-26*h*. As illustrated in FIGS. 5 and 6, each of the plates 26*a*-26*h* may be generally star-shaped with a central opening 56 for receiving the shaft 22. The plates 26*a*-26*f* include a plurality of internal notches 58 that cooperate with one another to form the internal fluid flow slots 52 when the plates 26*a*-26*f* are stacked and connected to one another and connected to the shaft 22 with the internal notches 58 aligned with one another. The internal fluid flow slots 52 are aligned with the fluid flow ports 44 when the body 24 is connected to the shaft 22 (FIG. 10). The plate 26*g* may be void of an internal notch. When the plate 26*g* is void of the internal notch, the plate 26*g* forms a bottom of the internal fluid flow slots 52**.

In some embodiments, each of the plates **26*a*-26*c* may be provided with a plurality of external notches 60*a*-60*c* formed before placing the plates 26*a*-26*c* on the shaft 22 to form the body 24. The external notches 60*a*-60*c* are aligned with one another when the plates 26*a*-26*c* are stacked to form the external slots 54. In other embodiments, the external slots 54 may be formed in the body 24 after the plates 26*a*-26*c* are connected together. In the example shown, the plate 26*d* is void of an external notch; thus, the plate 26*d* forms a base or bottom of the external slots 54. In this manner, the external slots 54 terminate prior to reaching the trailing end 50 of the body 24. The plate 26*d* may also have a plurality of protrusions 60 that may function as a surface extension for the blades 28** as will be described below.

The plates 26*e* and 26*f* may be of equal size and shape and have a plurality of protrusions 62 that are sized to provide an outermost diameter or gauge for facilitating the packing, smoothing, and cleaning of the borehole without generating substantial additional cuttings.

The plates 26*g* and 26*h* may be similar to the plates 26*e* and 26*f* but have protrusions 64*a* and 65*a*, respectively, with diameters less than the protrusions 62 of the plates 26*e* and 26*f* to form a stairstep configuration that can support a plurality of skis in a manner to be discussed below. In another embodiment, the plates 26*g* and 26*h* may be eliminated.

Referring now to FIGS. 7-10, in some embodiments, the blades 28 have a shape so as to mate against the body 24, preferably after the plates 26*a*-26*c* are connected together. In some non-limiting embodiments, the blades 28 have a generally inverted L-shape with a first leg 61*a* and a second leg 61*b*. The first leg 61*a* has an inward face 63 and a lower face 64. The inward face 63 may contact the outer peripheral surface 38 of the shaft 22 when assembled. The lower face 64 of the first leg 61*a* may have a groove 66 extending laterally across the lower face 64. As shown in FIG. 10, when the blades 28 are assembled to the body 24 and the shaft 22, the grooves 66 are in fluid communication with the internal fluid flow slots 52 of the body 24, so that each of the grooves 66 functions as a nozzle. In this way, fluid flow is directed through the central fluid flow passage 42 of the shaft 22, through the fluid flow ports 44, through the internal fluid flow slots 52, and through the groove 66 from which the fluid exits on either side of the blade 28 and is directed between adjacent blades 28. It should be appreciated that the grooves 66 may have one end closed so that fluid is directed in one direction only rather than two.

The second leg 61*b* is configured to seat in the external slots 54 of the body 24 with a lower face 68 in contact with the upper side of the plate 26*d*.

Figure 8:
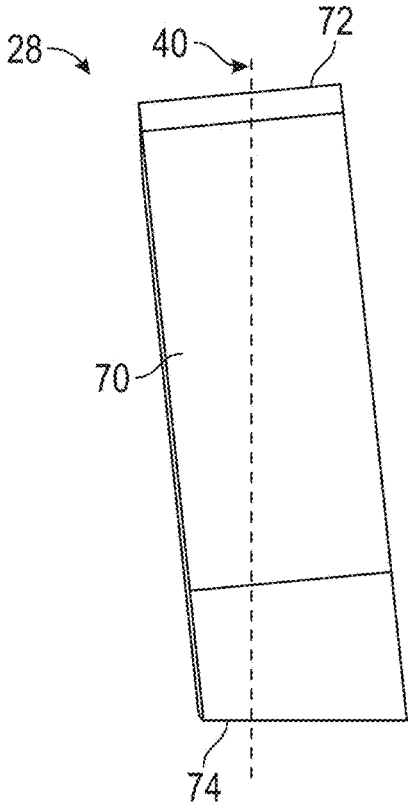
FIG. 8 is a side elevational view of the blade of FIG. 7 showing a desired orientation of the blade relative to a longitudinal axis of the reamer.

Each of the blades 28 has an outer peripheral surface 70 with a leading end 72 and a trailing end 74. The outer peripheral surface 70 of each of the blades 28 has a curved profile extending from a first predetermined distance from the leading end 72 of the blade 28 towards the trailing end 74 of the blade 28. The first predetermined distance can vary depending upon the size of the blades 28. In some embodiments, the first predetermined distance can be from zero to 1 inch. In one embodiment, the lower face 68 is angled in a non-perpendicular relationship relative to the vertical sides of the blades 28, which are parallel to one another. As such, the trailing end 74 is angled such that the leading end 72 and the trailing end 74 are horizontally offset relative to one another, and thus the outer peripheral surface 70 of the blade 28 is not parallel, i.e., angled, relative to the longitudinal axis 40 of the shaft 22, as best shown in FIG. 8. The blade 28 may be angled in a range from 3-10 degrees relative to the longitudinal axis 40. In some embodiments, the blade 28 is angled 5 degrees relative to the longitudinal axis 40.

Figure 9:
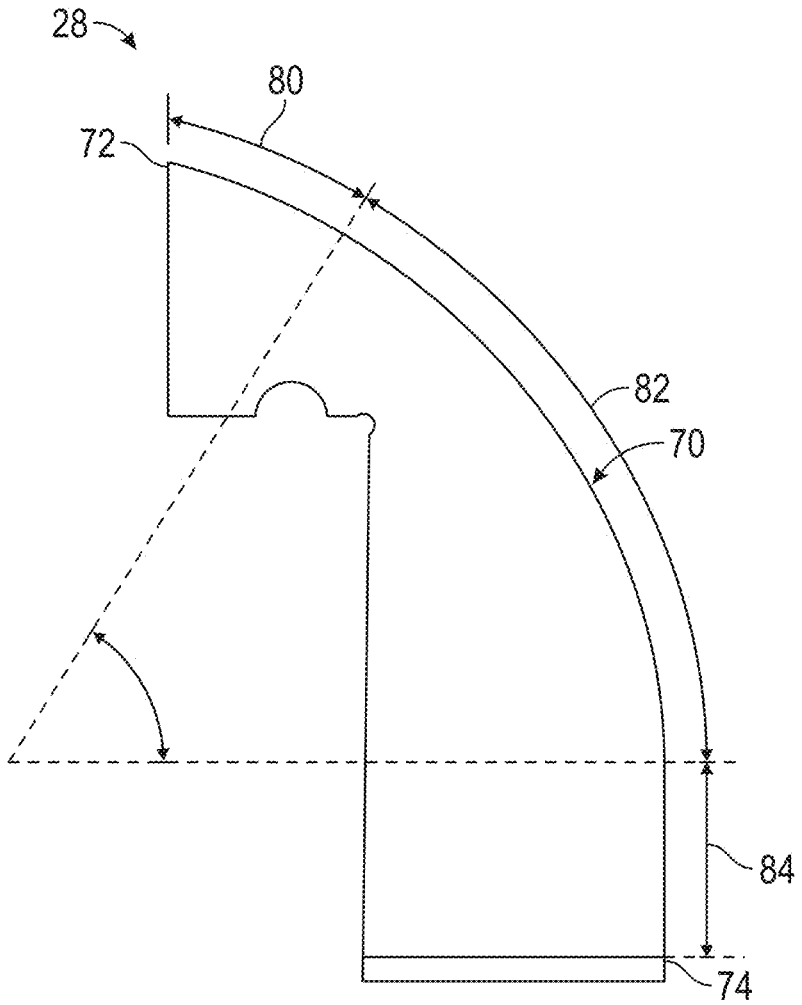
FIG. 9 is a front elevational view of the blade of FIG. 7.

Referring now to FIG. 9, the outer peripheral surface 70 of the blade 28 is configured to have a curved profile extending from the leading end 72 towards the trailing end 74 of the blade 28. In one embodiment, the blade 28 has a cone section 80 extending from the leading end 72 of the blade 28 toward the trailing end 74 of the blade 28, a shoulder section 82 extending from the cone section 80 toward the trailing end 74 of the blade 28, and a gauge section 84 extending from the shoulder section 82 to the trailing end 74 of the blade 28. In this embodiment, the curved profile includes the cone section 80 and the shoulder section 82. The cone section 80 tapers away from the leading end 72 along a substantially straight line. In one embodiment, the cone section 80 may be formed to extend from the leading end 72 of the blade 28 in a curved manner through a region of the blade 28 encompassing approximately 20 degrees from the horizontal. The cone section 80 facilitates the reamer 20 remaining substantially centered relative to the pilot hole. The shoulder section 82 is curved from the cone section 80 to the gauge section 84. In one embodiment, the shoulder section 82 may have a uniform shoulder radius. The radius of the shoulder section 82 may be varied depending on the desired size of the reamer 20. The gauge section 84 is substantially parallel to the longitudinal axis of the shaft.

Figure 11:
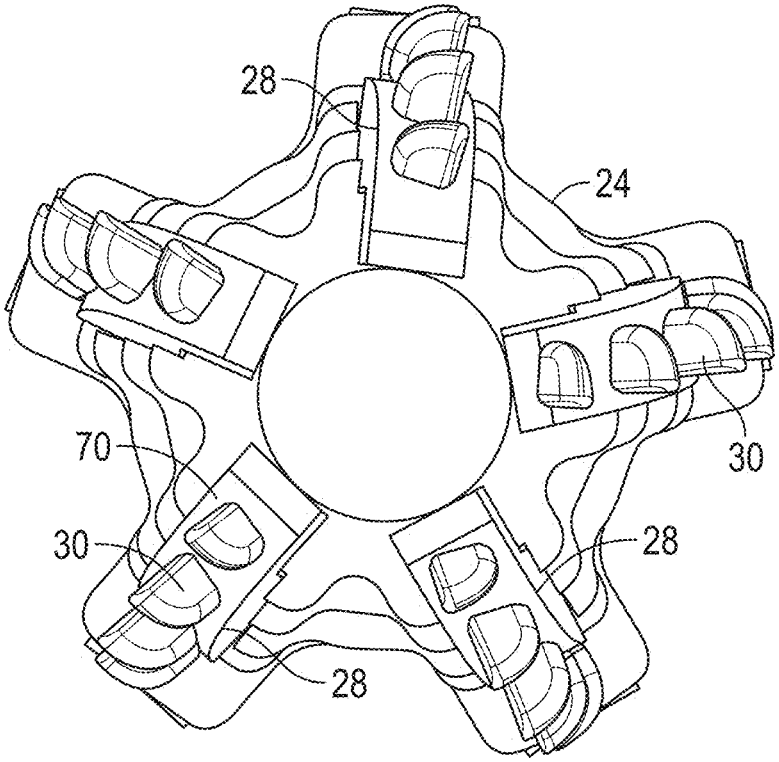
FIG. 11 is a top-plan view of a combination of the body, the blades, and a plurality of cutting elements having a non-cylindrical shape configured to cut through dirt and being attached to the blades.
Figure 12:
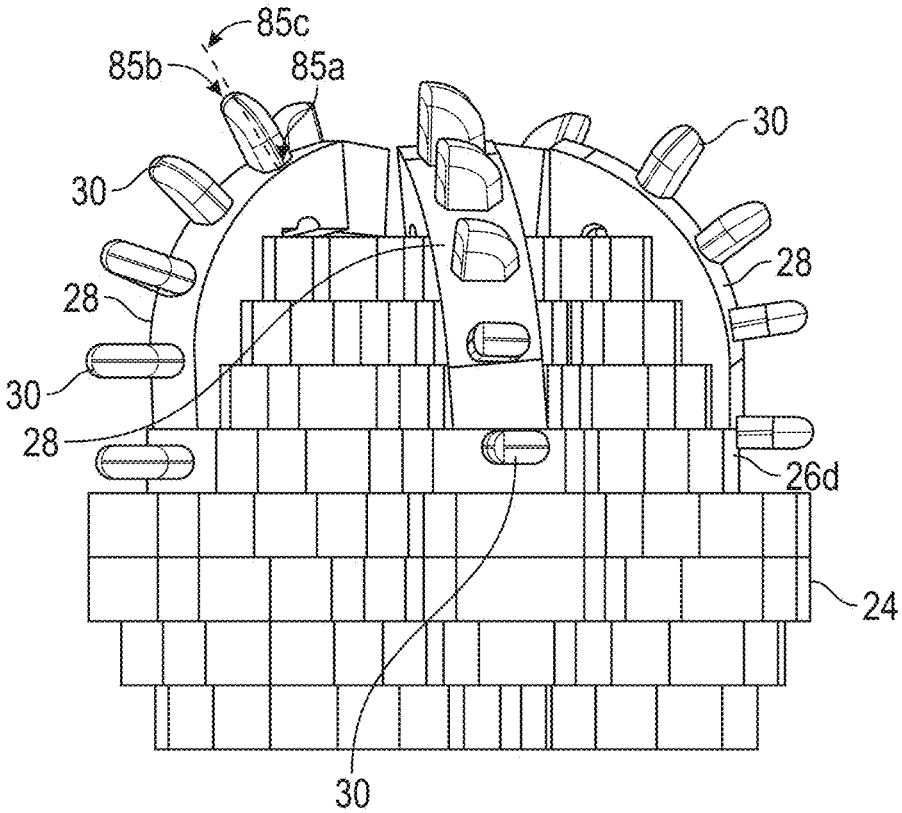
FIG. 12 is a right-side elevational view of the combination of the body, the blades, and the plurality of cutting elements of FIG. 11.
Figure 13:
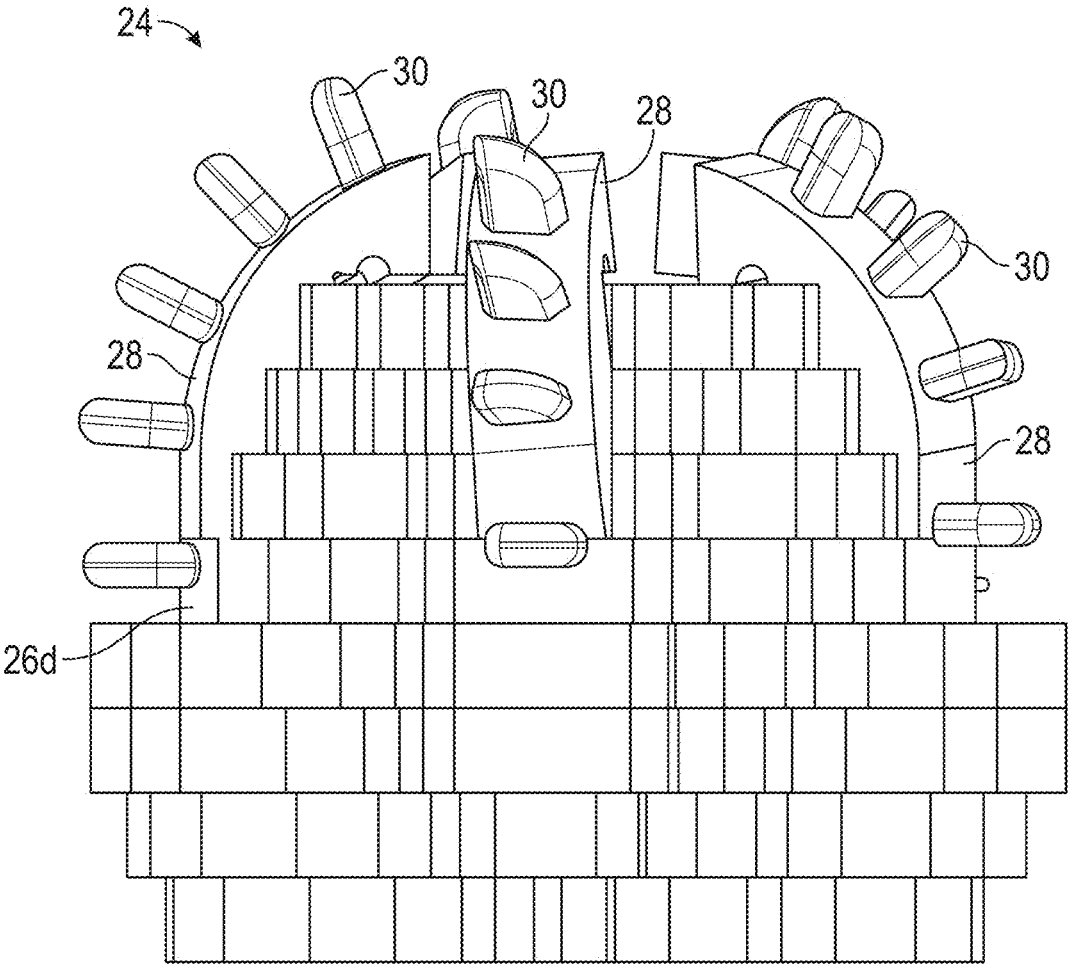
FIG. 13 is a left-side elevational view of the combination of the body, the blades, and the plurality of cutting elements of FIG. 11.

Referring now to FIGS. 11-13, the cutting elements 30 are supported by and extend from the outer peripheral surface 70 of each of the blades 28 in a spaced-apart relationship and are typically oriented in the direction of rotation. In some embodiments, each of the cutting elements 30 has a base 85*a*, a top 85*b*, and a longitudinal axis 85*c* extending between the base 85*a* and the top 85*b*. For purposes of clarity, only one of the cutting elements 30 has been labeled with the reference numerals 84*a*, 85*b* and 85*c* (FIG. 12) The base 85*a* of each cutting element 30 is connected to the outer peripheral surface 70 of one of the blades 28. The longitudinal axis 85*c* of the cutting elements 30 may be normal relative to a portion of the blade 28 engaged by the base 85*a* of the cutting element 30. In some embodiments, the angle of the longitudinal axis 85*c* of the cutting elements 30 relative to the portion of the blade 28 engaged by the base 85*a* is within +/−45 degrees of normal. This angle is known in the art as the backrake angle. The cutting elements 30 also have a siderake angle relative to the portion of the blade 28 engaged by the base 85*a*. The siderake angle is known in the art and is an angle formed by rotating the cutting element 30 about the longitudinal axis 85*c*. The siderake angle can vary depending upon where the cutting elements 30 are mounted to the blades 28 as shown in FIG. 12, for example. In general the siderake angle can be in a range of +/−45 degrees relative to normal.

At least some of the cutting elements 30 having a non-cylindrical shape configured for cutting through dirt. In some embodiments, the cutting elements 30 are picks which may be constructed of tungsten carbide, for example. As mentioned above, the outer peripheral surface 70 of each of the blades 28 is angled relative to the longitudinal axis of the shaft 22. To this end, the cutting elements 30 are in a longitudinally offset relationship with respect to the plurality of cutting elements 30 on the same blade 28. Additionally, as shown in FIGS. 11-13, the arrangement of the cutting elements 30 is different on each of the blades 28 so that the cutting elements 30 are laterally offset with respect to the cutting elements 30 on an adjacent blade. Each of the cutting elements 30 may have a length substantially equal to the length of the other cutting elements 30. The arrangement of the cutting elements 30 along the profile of the blades 28 promotes point loading on the subsurface 12, which occurs when a cutting element 30 is placed in a way that maximizes the work the cutting element 30 can do with the least amount of input (torque in this situation). In one embodiment, at least one of the plurality of cutting elements 30 extends from each of the cone section 80, the shoulder section 82, and the gauge section 84. In one embodiment, each of the blades 28 includes four or five cutting elements 30 depending on the position of the cutting elements 30 of the adjacent blades 28.

Additionally, the peripheral surface of the plate 26*d* functions as an extension of the outer peripheral surface 70 of the blades 28 and may be utilized as a surface for connecting cutting elements 30.

The cutting elements 30 may be varied in form but in the examples shown in FIGS. 10-15 are generally of the type formed of a steel substrate with a cutter constructed of a more durable material having an extremely high hardness and abrasion resistance, such as tungsten carbide that is configured for cutting through dirt. In these embodiments, the cutting elements 30 may have a non-cylindrical shape, such as the hook shape shown in FIGS. 10-15. In other embodiments, the cutting elements 30 may be configured to cut through rock. In these embodiments, the cutting element 30 may be provided with a cylindrical shape and having a cutter constructed of diamond, such as polycrystalline diamond compact (PDC), which is a compact of a polycrystalline diamond layer and a tungsten carbide substrate. The polycrystalline diamond layer possesses extremely high hardness and abrasion resistance, whereas the tungsten carbide substrate greatly improves the toughness and weldability of the whole compact.

Referring again to FIG. 2, the reamer 20 may include additional cutting elements 90 extending from the outer peripheral surface 38 of the shaft 22. The cutting elements 90 may be positioned forward of the body and staggered between the blades 28.

When utilized, a plurality of skis 92 (FIGS. 2 and 3) may be connected between the trailing end 50 of the body 24 and the shaft 22. The skis 92 are curved members with one end connected to the protrusion of the plates 26*g* and 26*h* and an opposing end connected to the outer peripheral surface 38 of the shaft 22. In other embodiments, the skis 92 may be eliminated.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made that will readily suggest themselves to those skilled in the art and which are accomplished within the scope of the inventive concepts disclosed and as defined in the appended claims.

What is claimed is:

1. A reamer, comprising:

a shaft having a leading end, a trailing end, an outer peripheral surface, and a first longitudinal axis;

a body connected to and extending from the outer peripheral surface of the shaft, the body having a leading end, and a trailing end;

a plurality of blades extending outwardly from the body, the plurality of blades each having a leading end, a trailing end, and an outer peripheral surface extending from the leading end of the blade to the trailing end of the blade, the outer peripheral surface having a curved profile extending from a first predetermined distance from the leading end of the blade toward the trailing end of the blade; and a plurality of cutting elements extending outwardly from the outer peripheral surface of each of the blades in a spaced-apart, longitudinally offset relationship with respect to the plurality of cutting elements on a same blade and laterally offset with respect to the cutting elements on an adjacent blade, each of the cutting elements having a base, a top, and a longitudinal axis extending between the base and the top, the base of each cutting element connected to the outer peripheral surface of one of the blades;

wherein the body includes a plurality of plates stacked on one another, and a plurality of external slots extending from the leading end of the body toward the trailing end of the body and spaced circumferentially about the body, and wherein blades are positioned within respective external slots.

2. The reamer of claim 1, wherein the longitudinal axis of the cutting elements is within +/−45 degrees of normal relative to a portion of respective blades engaged by bases of the respective cutting elements.

3. The reamer of claim 1, wherein at least some of the plurality of plates include a notch formed before placing the plates on the shaft to form the body, the notches of adjacent pairs of the plurality of plates forming the external slots.

4. The reamer of claim 1, wherein the plurality of plates are stacked on one another along the longitudinal axis of the shaft.

5. The reamer of claim 1, wherein the plurality of plates are welded to one another and to the shaft.

6. The reamer of claim 1, wherein one of the plurality of plates forms a closed lower end of at least some of the slots of the body, at least a portion of the one of the plurality of plates forming the closed lower end.

7. The reamer of claim 1, wherein the cutting elements are selected from a group comprising picks, teeth or cylindrical cutting elements.

8. The reamer of claim 6, wherein one or more of the cutting elements extend from the outer peripheral surface of the plate forming the closed lower end.

9. The reamer of claim 8, wherein the plurality of blades have a gauge section adjacent to the trailing end, and wherein the plates forming the closed lower end has an outer peripheral surface that is substantially flush with the gauge sections of the plurality of blades.

10. The reamer of claim 1, wherein the first predetermined distance is within a range from zero to ½ inch.

11. The reamer of claim 1, wherein the cutting elements are selected from a group comprising picks or teeth.

12. The reamer of claim 11, wherein the picks or teeth are constructed of tungsten carbide.

13. The reamer of claim 1, wherein bases of a subset of the plurality of cutting elements are welded to the outer peripheral surface of one of the blades.

14. A reamer, comprising:

a shaft having a leading end, a trailing end, an outer peripheral surface, and a first longitudinal axis;

a body connected to and extending from the outer peripheral surface of the shaft, the body having a leading end, and a trailing end;

a plurality of blades extending outwardly from the body, the plurality of blades each having a leading end, a trailing end, and an outer peripheral surface extending from the leading end of the blade to the trailing end of the blade, the outer peripheral surface having a curved profile extending from a first predetermined distance from the leading end of the blade toward the trailing end of the blade; and a plurality of cutting elements extending outwardly from the outer peripheral surface of each of the blades in a spaced-apart, longitudinally offset relationship with respect to the plurality of cutting elements on a same blade and laterally offset with respect to the cutting elements on an adjacent blade, each of the cutting elements having a base, a top, and a longitudinal axis extending between the base and the top, the base of each cutting element connected to the outer peripheral surface of one of the blades, at least some of the cutting elements having a non-cylindrical shape configured for cutting through dirt;

wherein the body includes a plurality of plates stacked on one another, and a plurality of external slots extending from the leading end of the body toward the trailing end of the body and spaced circumferentially about the body, wherein blades are positioned within respective external slots, and wherein at least some of the plurality of plates include a notch formed before placing the plates on the shaft to form the body, the notches of adjacent pairs of the plurality of plates forming the external slots.

15. A reamer, comprising:

a shaft having a leading end, a trailing end, an outer peripheral surface, and a first longitudinal axis;

a body connected to and extending from the outer peripheral surface of the shaft, the body having a leading end, and a trailing end;

a plurality of blades extending outwardly from the body, the plurality of blades each having a leading end, a trailing end, and an outer peripheral surface extending from the leading end of the blade to the trailing end of the blade, the outer peripheral surface having a curved profile extending from a first predetermined distance from the leading end of the blade toward the trailing end of the blade; and a plurality of cutting elements extending outwardly from the outer peripheral surface of each of the blades in a spaced-apart, longitudinally offset relationship with respect to the plurality of cutting elements on a same blade and laterally offset with respect to the cutting elements on an adjacent blade, each of the cutting elements having a base, a top, and a longitudinal axis extending between the base and the top, the base of each cutting element connected to the outer peripheral surface of one of the blades, at least some of the cutting elements having a non-cylindrical shape configured for cutting through dirt;

wherein the body includes a plurality of plates stacked on one another, and a plurality of external slots extending from the leading end of the body toward the trailing end of the body and spaced circumferentially about the body, wherein blades are positioned within respective external slots, and wherein one of the plurality of plates forms a closed lower end of at least some of the slots of the body, at least a portion of the one of the plurality of plates forming the closed lower end.

16. The reamer of claim 15, wherein one or more of the cutting elements extend from the outer peripheral surface of the plate forming the closed lower end.

17. The reamer of claim 16, wherein the plurality of blades have a gauge section adjacent to the trailing end, and wherein the plates forming the closed lower end has an outer peripheral surface that is substantially flush with the gauge sections of the plurality of blades.

* * * * *